US005259538A

United States Patent [19]

Tardif

[11] Patent Number: 5,259,538

[45] Date of Patent: Nov. 9, 1993

[54] SQUEEZE CANTEEN FOR DISPENSING A LIQUID

[76] Inventor: Pierre Tardif, 206 St. Jacques, Longueuil, Quebec, Canada

[21] Appl. No.: 13,355

[22] Filed: Feb. 4, 1993

[51] Int. Cl.[5] ..... B67D 3/00

[52] U.S. Cl. ..... 222/528; 222/530; 222/214

[58] Field of Search ..... 222/211, 212, 214, 528, 222/530

[56] References Cited

U.S. PATENT DOCUMENTS

| | | | |
|---|---|---|---|
| 1,225,017 | 5/1917 | Decker | 222/530 |
| 2,908,426 | 10/1959 | Goldstein | 222/530 X |
| 2,957,614 | 10/1960 | Krajcovic | 222/530 X |
| 3,181,743 | 5/1965 | Libit et al. | 222/530 X |
| 4,446,994 | 5/1984 | Smith | 222/528 X |
| 5,131,571 | 7/1992 | Nolley | 222/530 X |

*Primary Examiner*—Gregory L. Huson
*Attorney, Agent, or Firm*—Michael Ebert

[57] ABSTRACT

A squeeze canteen for dispensing a potable liquid such as drinking water or fruit juice, the canteen including a container formed of resilient material for holding the liquid. The container outlet is closed by a removable cap provided with a nozzle in the form of a short, flexible tube that normally projects outwardly from the cap, the inlet of the tube communicating with the container. When the canteen is in its drinking mode and the container is squeezed, the resultant internal pressure forces liquid from the container through the tube from which it is ejected as a jet stream. Associated with the cap is a crimping device which, when operated by the user, puts the canteen in its sealing mode, the crimping device deflecting the nozzle tube and holding it in a bent state to block the flow of liquid and thereby seal the container.

7 Claims, 3 Drawing Sheets

Fig. 7.
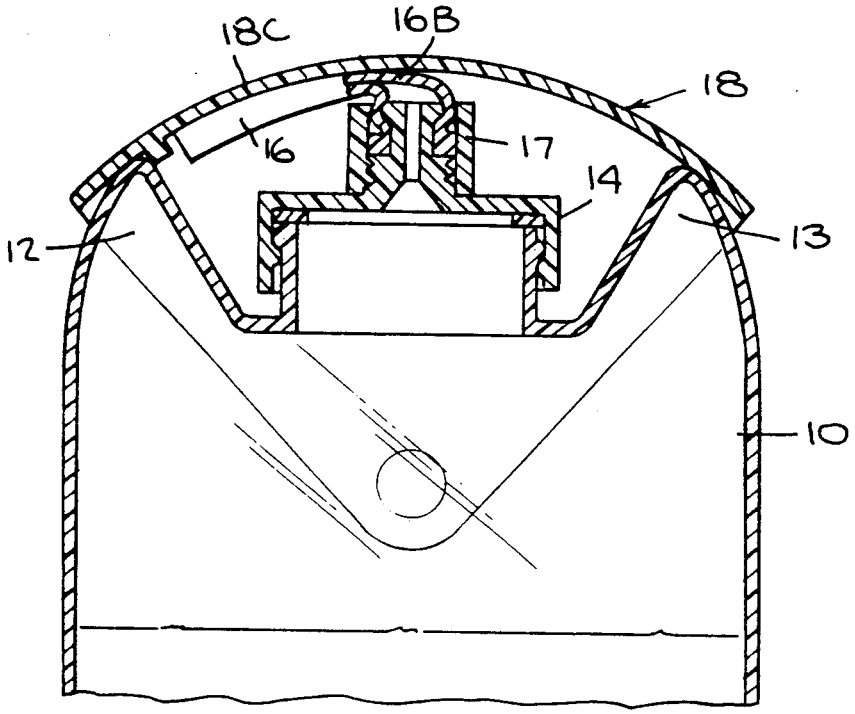
Fig. 6.
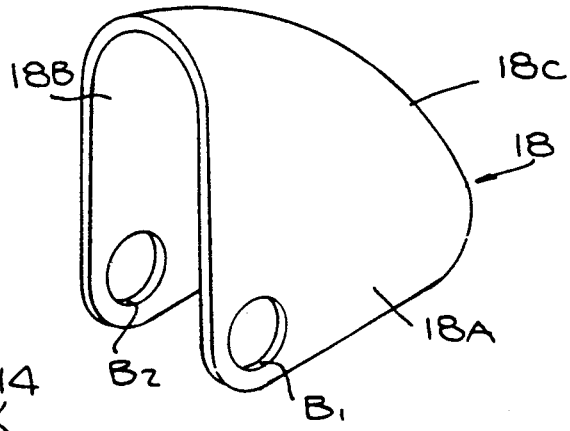
Fig. 5.
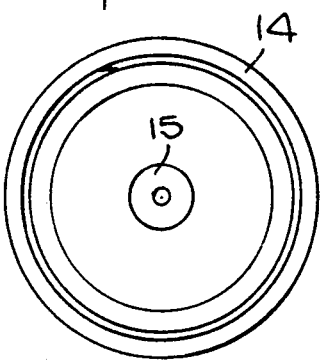
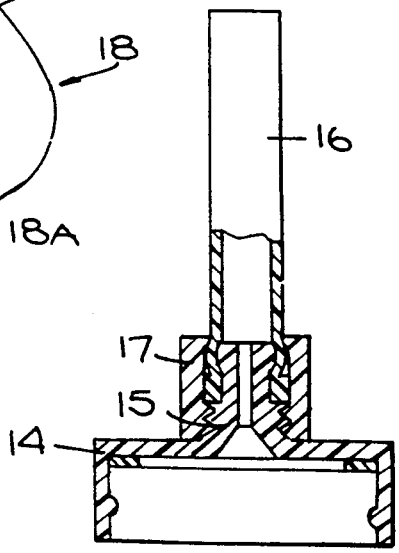
Fig. 4.

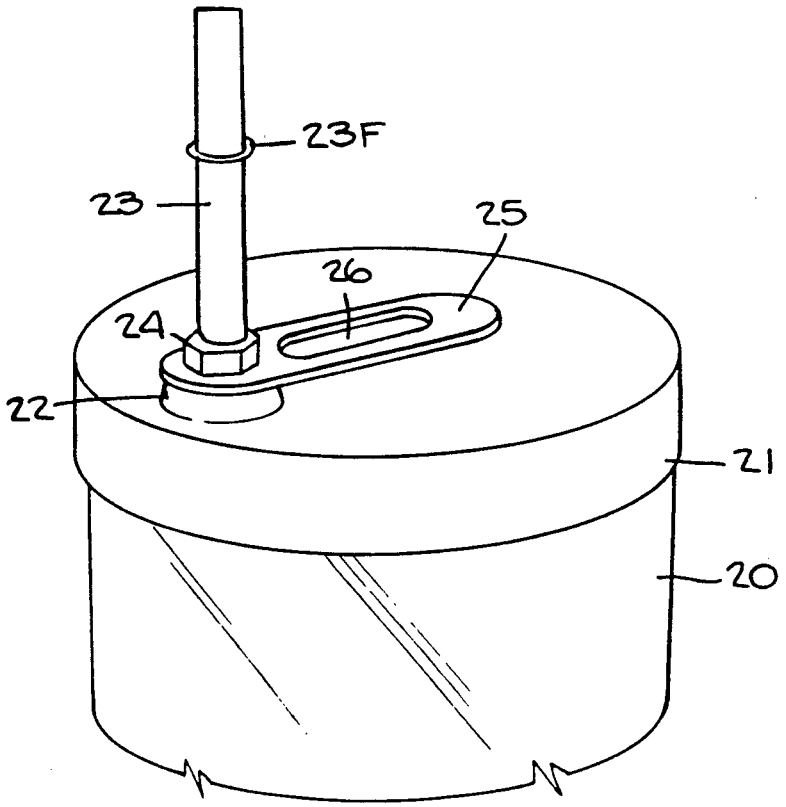
Fig. 8.
Fig. 9.
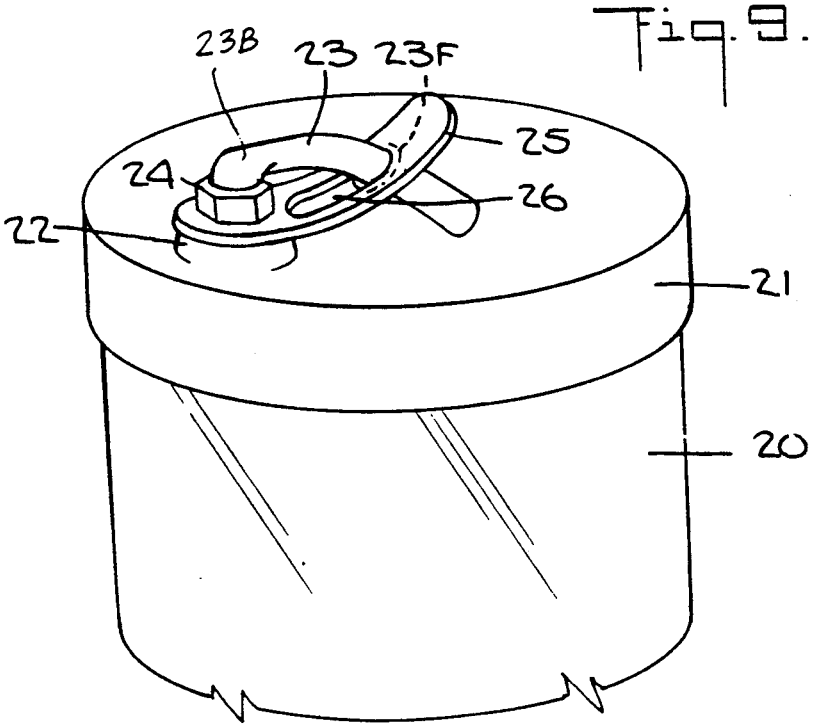

SQUEEZE CANTEEN FOR DISPENSING A LIQUID

BACKGROUND OF INVENTION

1. Field of Invention

This invention relates generally to canteens for storing potable liquids, and more particularly to a squeeze canteen provided with a closable nozzle that when open and the canteen is squeezed ejects a jet stream of liquid.

2. Status of Prior Art

A canteen is a flask for carrying drinking water or other potable liquids. Canteens are now commonly used by hikers and other travelers to carry potable liquids such as drinking water and fruit juice. Usually a canteen takes the form of a metal or plastic flask having a removable screw-on cap. These are not suitable for preschool or very young children; for in order to drink from a conventional canteen, the child must unscrew the cap, which is usually chained to the flask, and then put the threaded neck of the flask into his mouth. Since the flask is filled with liquid and is fairly heavy, a young child runs the risk of hitting and damaging his teen with the hard, threaded neck of the flask.

A conventional canteen operates on the gravity flow principle. In order, therefore, to drink from this canteen, the user must raise it to a level at which the liquid will flow downwardly into his mouth. This presents a problem when the user of the canteen is a child on a moving vehicle, for then it is difficult for the user to hold the canteen steady.

Moreover, there are many situations in which it is not convenient to use a conventional canteen or liquid container. For example, in a marathon race in which a runner carries with him a plastic bottle containing water, the runner is not in a position to unscrew the cap of the bottle and raise the bottle to his lips so that he can drink from it, for this is difficult to do without coming to a halt and losing ground.

The need exists, therefore, for a canteen from which one can drink without having to unscrew a cap and without having to put the threaded neck of the canteen into the mouth.

SUMMARY OF INVENTION

In view of the foregoing, the main object of this invention is to provide a squeeze canteen for storing a potable liquid and for ejecting the liquid as a jet stream when the canteen is squeezed.

Among the many advantages of this invention are that it obviates the need to unscrew the cap of the canteen in order to drink, and it does away with the need to raise the canteen to a position producing gravity flow, for the liquid will be ejected from the canteen only when it is squeezed.

More particularly, an object of this invention is to provide a squeeze canteen in which the liquid is ejected through a closable nozzle in the form of a short, flexible tube which, when deflected and held in a bent state, then closes the nozzle and thereby seals the canteen.

Still another object of the invention is to provide a squeeze canteen that operates efficiently and reliably and can be mass-produced at low cost.

Briefly stated, these objects are attained in a squeeze canteen for dispensing a potable liquid such as drinking water or fruit juice, the canteen including a container formed of resilient material for holding the liquid. The container outlet is closed by a removable cap provided with a nozzle in the form of a short, flexible tube that normally projects outwardly from the cap, the inlet of the tube communicating with the container. When the canteen is in its drinking mode and the container is squeezed, the resultant internal pressure forces liquid from the container through the tube from which it is ejected as a jet stream. Associated with the cap is a crimping device which, when operated by the user, puts the canteen in its sealing mode, the crimping device deflecting the nozzle tube and holding it in a bent state to block the flow of liquid and thereby seal the container.

In one preferred embodiment of a canteen in accordance with the invention, the crimping device associated with the cap is constituted by a sector-shaped hood that is hinged at its apex to the container and is swingable from a drinking mode, in which the nozzle tube is exposed, whereby when the container is squeezed, liquid is ejected from the tube, to a sealing mode, in which in the course of the swing, the tube is deflected and then held under the hood in a bent state to block the flow of liquid.

In another preferred embodiment, the crimping device associated with the cap is constituted by a flexible lug, one end of which is anchored on the cap, the lug having a slot therein. In the drinking mode, the nozzle tube is disengaged from the lug so that liquid can then flow through the tube, while in the sealing mode, the tube is extended through the slot in the lug and held thereby in a bent state to block liquid flow.

BRIEF DESCRIPTION OF DRAWINGS

For a better understanding of the invention as well as other objects and further features thereof, reference is made to the following detailed description to be read in conjunction with the accompanying drawing, wherein:

FIG. 4 is a section taken through the cap for the container;

FIG. 5 is a bottom view of the cap;

FIG. 6 is a separate view of the hood hinged onto the container;

FIG. 7 shows the canteen in its sealing mode, the hood being cut away to show the nozzle tube bend under the hood;

FIG. 8 is a perspective view of another preferred embodiment of a squeeze canteen in accordance with the invention, as seen in its drinking mode; and FIG. 9 shows the same canteen in its sealing mode.

DESCRIPTION OF INVENTION

First Embodiment

Figure 1:
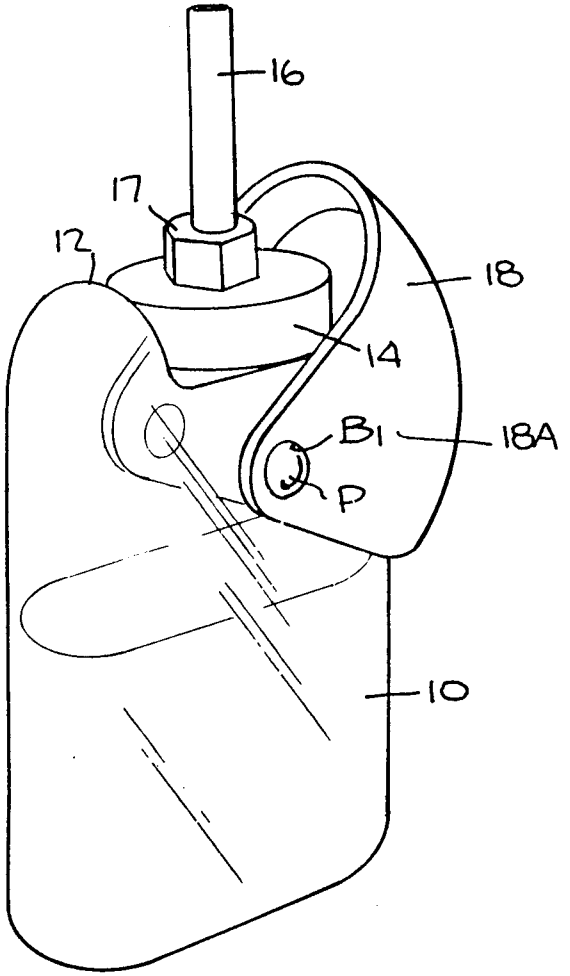
FIG. 1 is a perspective view of a preferred embodiment of a squeeze canteen in accordance with the invention, as seen in its drinking mode.
Figure 2:
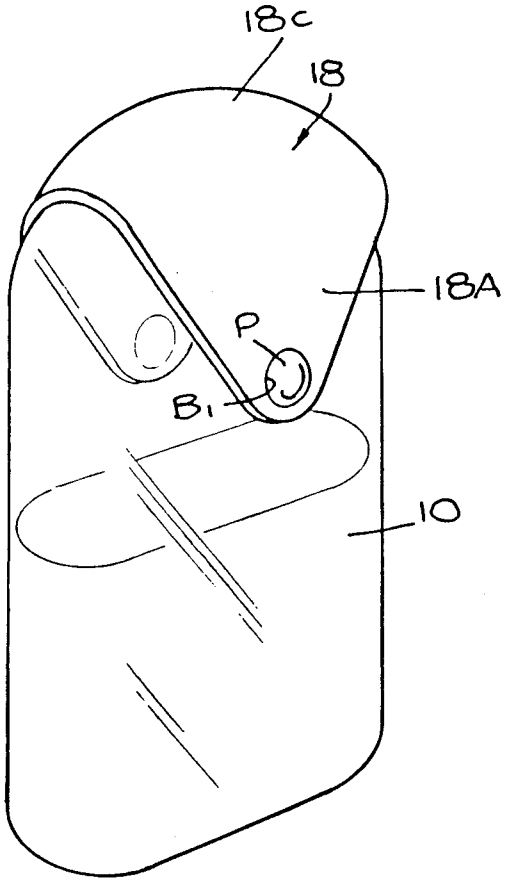
FIG. 2 shows the same canteen in its sealing mode.

Referring now to FIG. 1, shown therein is a squeeze canteen in accordance with the invention as it appears in its drinking mode, in which the canteen dispenses potable liquid such as drinking water or fruit juice held in a container 10 which is squeezable by the user. In the sealing mode of the canteen, as shown in FIG. 2, the container is sealed and, if squeezed, no liquid will be ejected therefrom.

Figure 3:
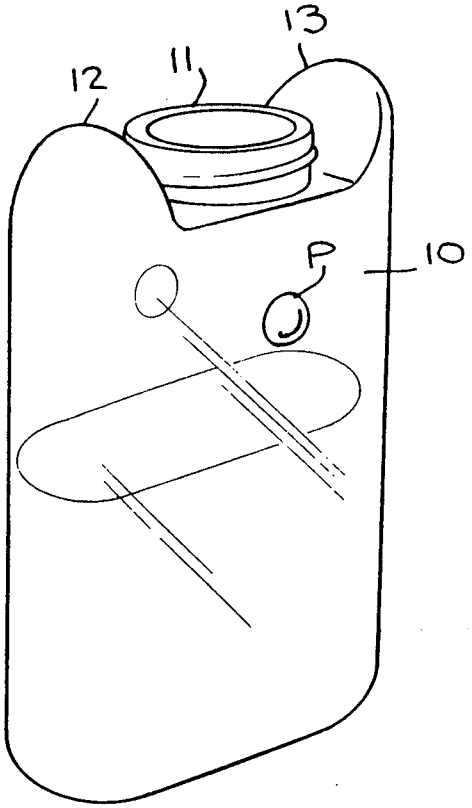
FIG. 3 is a separate perspective view of the container included in the canteen.

As shown separately in FIG. 3, container 10 is molded of a transparent, resilient, synthetic plastic material which is impermeable to liquid and has high strength, such as polypropylene or polyethylene. In this way, the user of the canteen can see the liquid contents and the extent to which the container is depleted.

Container 10 has an oblong cross section so that it can be conveniently carried in the pocket of a garment worn by the user. It includes parallel side walls which are flexible and therefore can be squeezed inwardly by the fingers of the user's hand. Formed on the top wall of container 10 at its center is an externally-threaded neck 11 which acts as the container's inlet-outlet.

Also formed on the top wall of container 10 on either side thereof are like rounded humps 12 and 13 whose peaks are higher than neck 11. The humps include oppositely inclined flat sides which are spaced from neck 11 to allow room for a screw-on removable cap 14 which screws onto neck 11.

As shown separately in FIGS. 4 and 5, cap 14, which is cylindrical and internally-threaded, is provided at its center with a nipple 15 on which is received the inlet end of a short nozzle tube 16 of flexible plastic material, such as PVC. The tube is joined to nipple 15 by a collar 17, thereby anchoring the nozzle tube on the cap. The nozzle tube normally projects upwardly from the cap in the drinking mode of the canteen.

Hinged to the container is a sector-shaped hood 18 molded of flexible, opaque, synthetic plastic material such as PVC or polyethylene. The hood functions as a crimping device, which in the sealing mode of the canteen deflects the nozzle tube so that it lies under the hood and puts a bend therein which blocks the flow of liquid through the tube.

Hood 18 is formed by parallel side walls 18A and 18B having a triangular shape, the side walls being bridged by an arched roof 18C. Bores $B_1$ and $B_2$ adjacent the apex of each side wall are dimensioned to receive pivot busses P formed on the side walls of container 10 below neck 11.

Hood 18 is swingable by the user from the offset position shown in FIG. 1, which puts the canteen in its drinking mode, to the symmetrical position shown in FIG. 2, which puts the canteen in its sealing mode. In the offset position, hood 18 overlies right hump 13 which conforms to arched roof 18C. In the symmetrical position, hood 18 is then symmetrically disposed with respect to humps 12 and 13 to cover cap 14 and tube 16.

As shown in FIG. 7, in the sealing mode of the canteen, hood 18 deflects nozzle tube 16 to force it under the hood and create a bend 16B in the tube, which acts to block the flow of liquid therethrough, thereby sealing the container. Thus, to operate the canteen, the user has only to swing the hood to put the canteen in the drinking mode, and then squeeze the container to dispense the liquid.

Second Embodiment

In the squeeze canteen shown in FIGS. 8 and 9, use is made of a cylindrical container 20 formed of transparent, resilient, synthetic plastic material for storing a supply of the potable liquid to be dispensed. In this embodiment, the container may have a greater liquid capacity than that in the first embodiment. The mouth of container 20 is externally threaded to receive a cylindrical screw-on cap 21. Cap 21 is provided with a nipple 22 adjacent its periphery. Joined to nipple 22 is the inlet end of a short, flexible nozzle tube 23, the tube being joined to the nipple by a collar 24 so that the tube is normally upright.

Underlying collar 24 and linked to nipple 22 is one end of a lug 25 of flexible plastic material having an elongated slot 26 therein. In the drinking mode of the canteen, as shown in FIG. 8, nozzle tube 23 is disengaged from lug 25 and is upright, so that when container 21 is squeezed, the resultant internal pressure forces liquid from the container through nozzle tube 23, from which it is ejected as a jet stream.

To put the canteen in its sealing mode, the user bends tube 23 and passes it through slot 26 in lug 25 which acts as a crimping device, for lug 25 holds the tube to maintain the bend 23B therein and thereby block the flow of liquid through the tube. Tube 23 is provided at an intermediate position with an annular flange 23F of enlarged diameter, which, when the tube is inserted in the slot, as shown in FIG. 9, flange 23F then engages the upper edge of the slot to resist withdrawal of the tube which seeks to regain its upright position.

Thus in this canteen, all that is necessary to put the canteen in its sealing mode is to bend tube 23 and pass it through slot 26 of lug 25; and when one wishes to drink from the canteen in its drinking mode, one simply pulls the tube out of the slot.

While there have been shown and described preferred embodiments of a squeeze container in accordance with the invention, it will be appreciated that many changes and modifications may be made therein without, however, departing from the essential spirit thereof.

I claim:

1. A squeeze canteen for dispensing a potable liquid, said canteen comprising:

(a) a container formed of resilient, synthetic plastic material for holding the liquid and having an outlet;

(b) a removable cap covering the outlet and provided with a nozzle tube of flexible plastic material that is anchored on the cap and normally projects outwardly therefrom, the inlet of the tube communicating with the container, whereby in a drinking mode of the canteen in which the container is squeezed, the resultant internal pressure forces liquid from the container through the tube from which it is ejected as a jet stream; and (c) a crimping device associated with the cap, which in a sealing mode of the container deflects the nozzle tube and holds it in a bent state to block the flow of fluid therethrough, said crimping device being formed by a hood that is hinged to the container and is swingable from a drinking mode position in which the tube is exposed and projects from the cap to a sealing mode position in which the tube is maintained in a bent state under the hood.

2. A canteen as set forth in claim 1, in which the container is formed of transparent material.

3. A canteen as set forth in claim 1, in which the container has on its top an externally-threaded cylindrical neck forming the outlet of the container, and said cap is cylindrical and internally-threaded to screw onto the neck.

4. A canteen as set forth in claim 3, in which the cap is provided at its center with a nipple and the inlet end of the tube is joined to the nipple by a collar.

5. A canteen as set forth in claim 1, in which the container has an oblong cross section and its top is provided with a pair of humps on either side of the neck, and said crimping device is formed by a sector-shaped hood which is hinged to the container, and in the sealing mode of the container is symmetrical with respect to the humps and deflects the tube to force it under the hood to impart a bend thereto, and in the drinking mode is swung to overlie one of the humps and expose the nozzle tube.

6. A canteen as set forth in claim 1, in which the hood is formed of a pair of parallel triangular side walls and an arched roof bridging the side walls, each side wall having a bore adjacent its apex in which is received a boss formed on a side wall of the container.

7. A canteen as set forth in claim 6, in which the humps are rounded to conform to the contour of the arched roof.

* * * * *